US006560430B2

(12) United States Patent
Muto et al.

(10) Patent No.: US 6,560,430 B2
(45) Date of Patent: May 6, 2003

(54) DEVELOPING UNIT HAVING AN OPENING ALLOWING TONER TO FALL DIRECTLY ONTO A DEVELOPING MEMBER AND SUPPLYING MEMBER CONTACT AREA

(75) Inventors: Eisaku Muto, Tokyo (JP); Noboru Ooishi, Tokyo (JP); Shigenori Koido, Tokyo (JP); Tetsu Koyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/963,837

(22) Filed: Sep. 25, 2001

(65) Prior Publication Data

US 2002/0041778 A1 Apr. 11, 2002

(30) Foreign Application Priority Data

Sep. 29, 2000 (JP) ..... 2000-299645

(51) Int. Cl.[7] ..... G03G 15/08

(52) U.S. Cl. ..... 399/255; 399/258; 399/281; 399/284

(58) Field of Search ..... 399/222, 252, 399/258, 260, 262, 281, 284, 254, 255

(56) References Cited

U.S. PATENT DOCUMENTS 5,101,237 A * 3/1992 Malloy ..... 399/260
5,606,397 A * 2/1997 Honda et al. ..... 399/222 X
6,341,206 B1 * 1/2002 Yamaguchi et al. .... 399/284 X

* cited by examiner

*Primary Examiner*—William J. Royer
(74) *Attorney, Agent, or Firm*—Akin, Gump, Strauss, Hauer & Feld, L.L.P.

(57) ABSTRACT

A developing unit is disposed substantially directly under a toner chamber and receives toner through an opening formed in the toner chamber, and includes a developing roller, a supplying roller, and a developing blade. The developing roller supplies toner to an electrostatic latent image formed on an image bearing body. The supplying roller rotates in contact with the developing roller to supply the toner to the developing roller. The developing blade is in pressure contact with the developing roller to form a thin layer of toner on the developing roller. The developing blade is in contact with the developing roller at a first position spaced at least 5.84 mm from a second position at which the supplying roller is in contact with the developing roller. An agitating member may be added over the developing roller and supplying roller and between the first position and the second position.

18 Claims, 7 Drawing Sheets

DEVELOPING UNIT HAVING AN OPENING ALLOWING TONER TO FALL DIRECTLY ONTO A DEVELOPING MEMBER AND SUPPLYING MEMBER CONTACT AREA

BACKGROUND OF THE INVENTION

1. Field of the Invention

The present invention relates to a developing unit that supplies toner to an electrostatic latent Image formed on a surface of an image bearing body, and more particularly to a developing unit that has a developing toiler and a supplying roller and a toner accommodating section defined above the developing roller and supplying roller.

2. Description of the Related Art

A conventional electrophotographic color printer incorporates a plurality of image forming sections. Each of the image forming sections includes a developing unit to which a toner cartridge is detachably mounted.

The image forming section incorporates a photoconductor, a charging roller, a developing unit, and a cleaning section. The charging roller charges the surface of the photoconductor. An electrostatic latent image is formed on the charged surface of the photoconductor in accordance with print data. The developing unit causes toner to be deposited on the electrostatic latent image to develop the electrostatic latent image into a toner image. The developing unit includes a developing roller, a developing blade, and a supplying roller. The developing roller rotates in contact with the photoconductor to deposit toner on the surface of the photoconductor. The developing blade is in contact with the developing roller to regulate the thickness of the toner layer formed on the developing roller. The toner supplying roller rotates in contact with the developing roller to supply toner to the developing roller. A toner cartridge and a toner accommodating section are disposed away from the photoconductor.

A tandem type electrophotographic printer has a plurality of image forming sections spaced apart by an equal distance and aligned straight. The image forming sections are disposed over a belt on which a print medium is transported from section to section in sequence. The print medium passes under the respective image forming sections where toner images are transferred onto the print medium in order.

The problem with a tandem type printer is that the printer has a long dimension in a direction of travel of the print medium. In addition, with the advance of office automation in recent years, printing is performed more frequently. Thus, toner in a printer is used up soon and a need exists for a large toner accommodating space that requires less frequent replacement of the toner cartridge. However, providing a large toner accommodating space leads to a printer of a large size. This is against the users' trend toward a small size printer.

Attempts have been made to solve the aforementioned drawbacks of the conventional developing unit. That is, a larger toner accommodating section and a larger toner cartridge are disposed over a portion at which the developing roller is in contact with the supply roller, while also making the overall dimension of the printer shorter in a direction in which a plurality of image-forming sections are aligned.

The aforementioned conventional printer has a toner accommodating section and a toner cartridge disposed above an area at which the developing roller and supply roller are in contact with each other. The toner supplied from the toner cartridge causes a decrease in the fluidity of toner near the area in which the developing roller and supply roller are in contact with each other. Thus, old, clumped toner or foreign materials in the toner are trapped between the developing blade and the developing roller, preventing the fresh, new toner from being supplied thereto.

Foreign materials trapped between the developing blade and the developing roller cause white narrow areas or lines in a printed image in which toner is absent. Toner clumped between the developing blade and the developing roller causes partial insufficient toner deposition in the printed image.

FIG. 8 illustrates an example of print results in which when printing is performed with a print medium running in a direction shown by arrow A, some areas in the printed image have insufficient toner deposited. FIG. 8 shows a black image solidly printed over the entire area of print medium. It is to be noted that regions of insufficient deposition of toner P appear irregularly on a print medium 20 while other areas Q are printed black.

SUMMARY OF THE INVENTION

An object of the present invention is to provide a developing unit with fluid toner in an area where a developing roller and supplying roller are in contact engagement with each other, thereby preventing foreign materials or clumped toner from being trapped in the area.

Another object of the invention is to prevent white lines or low-density areas from appearing in a printed image.

A developing unit is disposed substantially directly under a toner chamber and receives toner through an opening formed in the toner chamber, and includes a developing roller, a supplying roller, and a developing blade. The developing roller supplies toner to an electrostatic latent image formed on an image bearing body. The supplying roller rotates in contact with the developing roller to supply the toner to the developing roller. The developing blade is in pressure contact with the developing roller to form a thin layer of toner on the developing roller. The developing blade is in contact with the developing roller at a first position spaced at least 5.84 mm from a second position at which the supplying roller is in contact with the developing roller. An agitating member may be added over the developing, roller and supplying roller and between the first position and the second position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Preferred embodiments of the present invention will be described in detail with reference to the accompanying drawings.

First Embodiment

Figure 1:
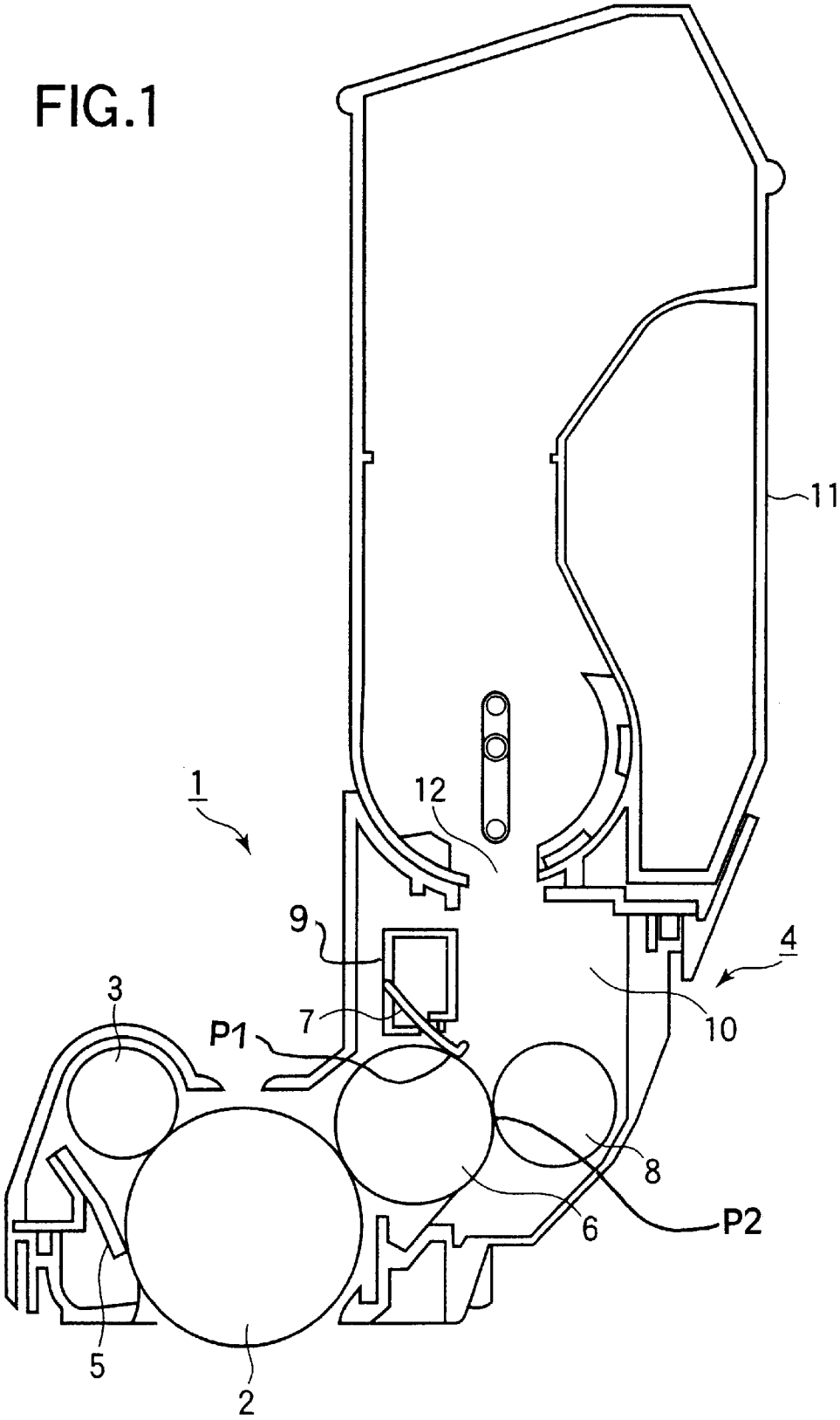
FIG. 1 is a cross-sectional view illustrating a developing unit according to a first embodiment of the invention.

FIG. 1 is a cross-sectional view illustrating a developing unit according to a first embodiment of the invention.

Referring to FIG. 1, an image forming section 1 includes a charging roller 3, a photoconductor 2, a developing unit 4, and a cleaning section 5. The charging roller 3 charges the surface of the photoconductor 2. Then, an electrostatic latent image is formed on the photoconductor 2 in accordance with print data. The developing unit 4 deposits toner to the electrostatic latent image formed on the photoconductor 2 to develop the electrostatic latent image into a toner image. The cleaning section 5 cleans the residual toner on the photoconductor 2 after transfer.

The developing unit 4 includes a developing roller 6, a developing blade 7, and a supplying roller 8. The developing roller 6 rotates in contact with the photoconductor 2 to deposit toner on the photoconductor 2. The developing blade 7 is in contact with the developing roller 6 to regulate the thickness of the toner layer formed on the developing roller 6. The developing blade 7 is mounted to a blade holder 9. The toner-supplying roller 8 rotates in contact with the photoconductor 2 to supply toner to the developing roller 6. A toner accommodating section 10 is disposed above the developing roller 6 and the supplying roller 8. A toner cartridge 11 is detachably attached to the upper portion of the toner accommodating section 10. The toner cartridge 11 has an opening 12 formed therein through which toner is discharged into the toner accommodating section 10.

The feature of the first embodiment is that the developing blade 7 is in contact with the developing roller 5 at a position P1 spaced at least a predetermined specific distance from a position P2 at which the supplying roller 8 is in contact with the developing roller 6, thereby increasing fluidity of the toner in the developing unit 4.

Figure 2:
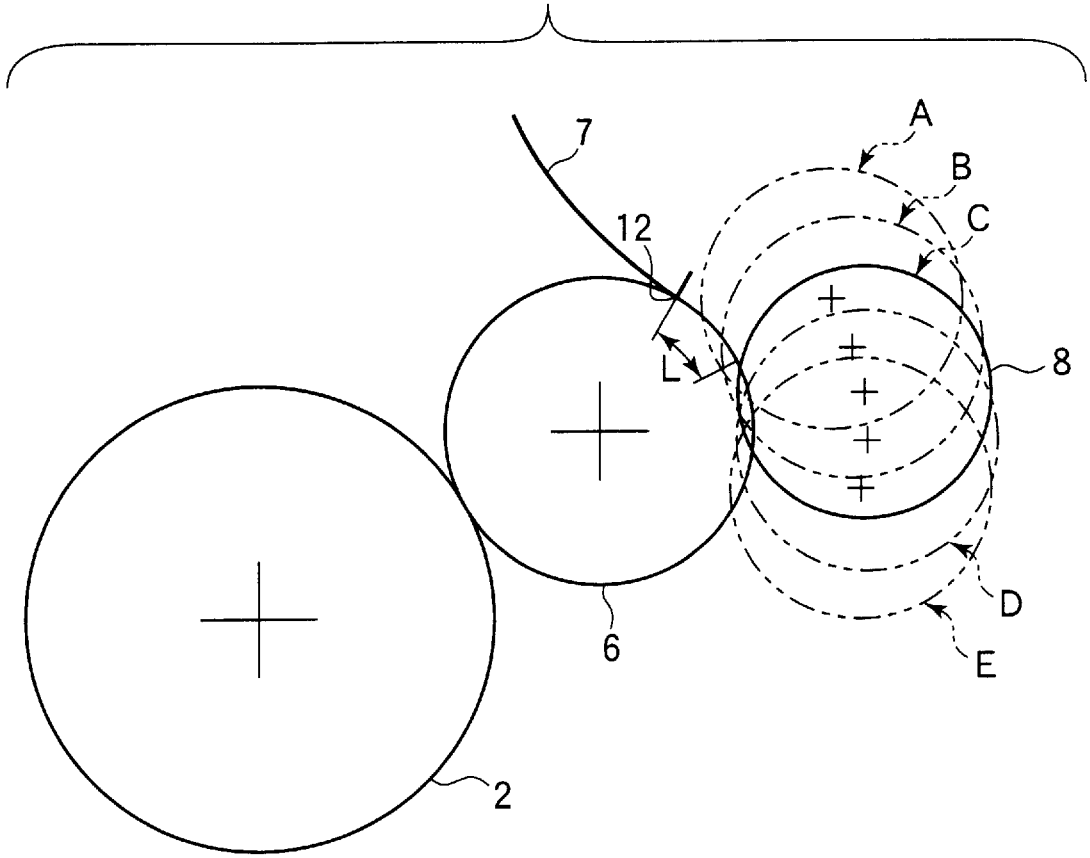
FIG. 2 illustrates the positions of a developing roller and a supplying roller according to a second embodiment of the invention.

FIG. 2 illustrates the various settings of position P2 relative to the position P1. An experiment was conducted to determine whether white lines appear in the print images. Table 1 lists the results of the experiment.

TABLE 1

| POSITION OF SUPPLYING ROLLER | A | B | C | D | E |
|---|---|---|---|---|---|
| DISTANCE L | 2.15 | 4.13 | 5.84 | 7.67 | 9.63 |
| WHITE LINES | YES | YES | NO | NO | NO |

The experiment was carried out for different settings A, B, C, D, and E of the distance L between the positions P1 and P2. The distance L is a center-to-center distance between nips formed at positions P1 and P2. The developing roller 6 is formed of silicone rubber or urethane rubber and has a diameter of 20 mm. The supplying roller 8 is formed of silicone sponge and has a diameter of 16 mm. As is clear form Table 1, white lines appeared for the positions up to setting B (4.13 mm) and were not observed for positions above setting B (5.84 mm or longer).

The mechanism in which white lines occur will be described with reference to FIGS. 3 and 4.

Figure 3:
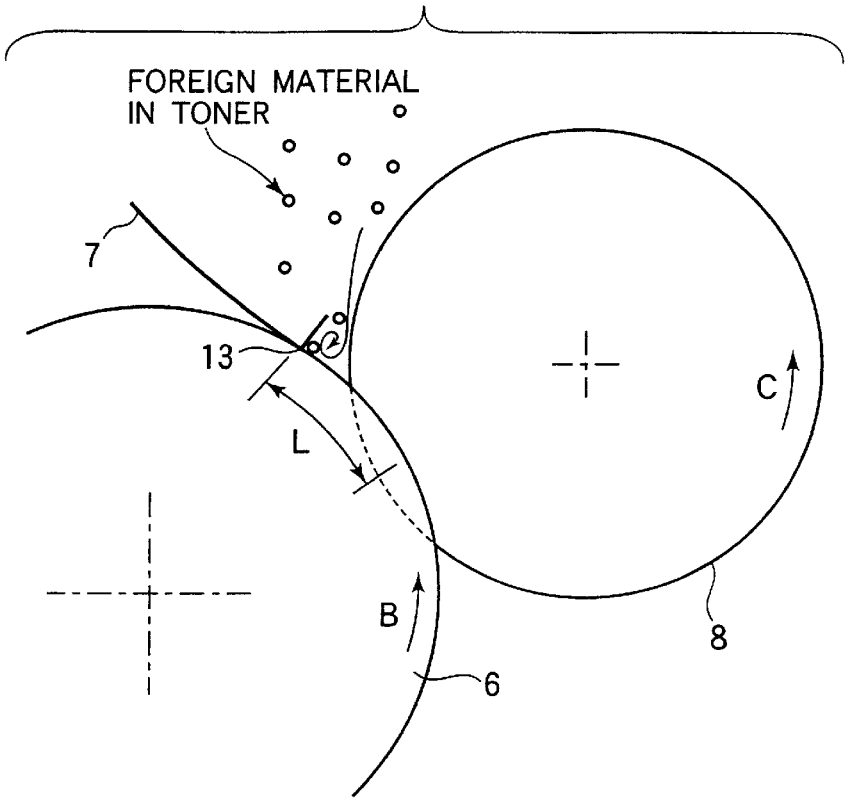
FIGS. 3 and 4 are illustrative diagrams of the mechanism in which white lines occur, FIG. 3 showing a case when a distance L is short and FIG. 4 showing a case when the distance L is long.
Figure 4:
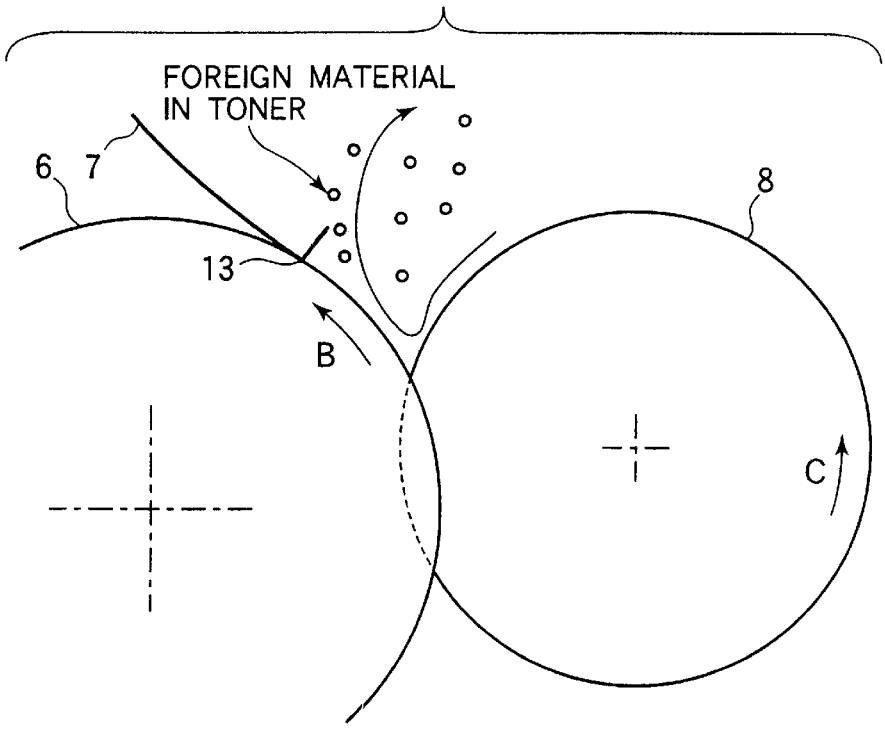

FIGS. 3 and 4 are illustrative diagrams of the mechanism in which white lines occur, FIG. 3 showing a case when the distance L is short and FIG. 4 showing a case when the distance L is long.

Referring to FIGS. 3 and 4, the developing roller 6 and supplying roller 8 rotate in directions shown by arrows B and C, respectively. The developing roller 6 and supplying roller 8 receive negative voltages. When the developing roller 6 and supplying roller 8 rotate, the toner will move to follow their rotations.

When the distance L is short as shown in FIG. 3, the toner will move to the developing roller 6 as the supplying roller 8 rotates. Then, the toner reached the developing roller 6 will move to a position 13 at which the developing blade 7 is in pressure contact with the developing roller 6. The foreign materials in the toner will also move to the position 13 as the developing roller 6 rotates.

Second Embodiment

If printing is performed with a low printing duty cycle (i.e., short printing time and long standby time between adjacent printing jobs) for a long time and the remaining toner is nearing exhaustion, the percentage of old, clumped toner and foreign materials in the remaining toner increases. If new, unused toner is replenished in the developing unit 4 from the toner cartridge, the pressure of the toner increases near an area where the developing roller 6 is in contact with the supplying roller 8. An increase in the pressure of toner results in poor fluidity of toner, causing areas of low density in a printed image. This phenomenon gradually decreases as the developing roller 6 continues to rotate and no significant variation of density can be seen in printed characters. However, satisfactory print quality cannot be obtained when a halftone image is printed. The second embodiment addresses this problem.

Figure 5:
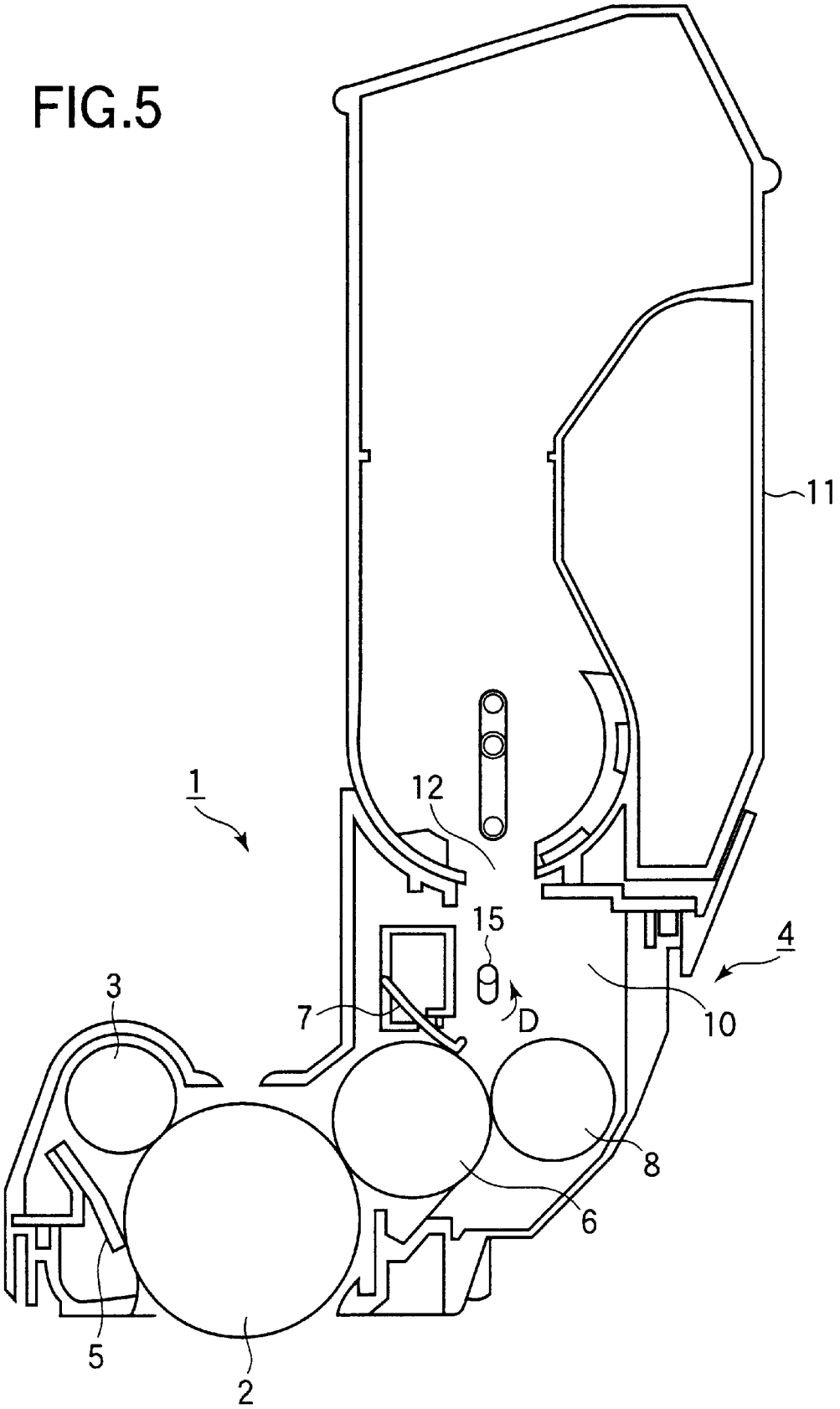
FIG. 5 is a cross-sectional view of a developing unit according to the second embodiment.

FIG. 5 is a cross-sectional view of a developing unit according to the second embodiment.

Figure 6:
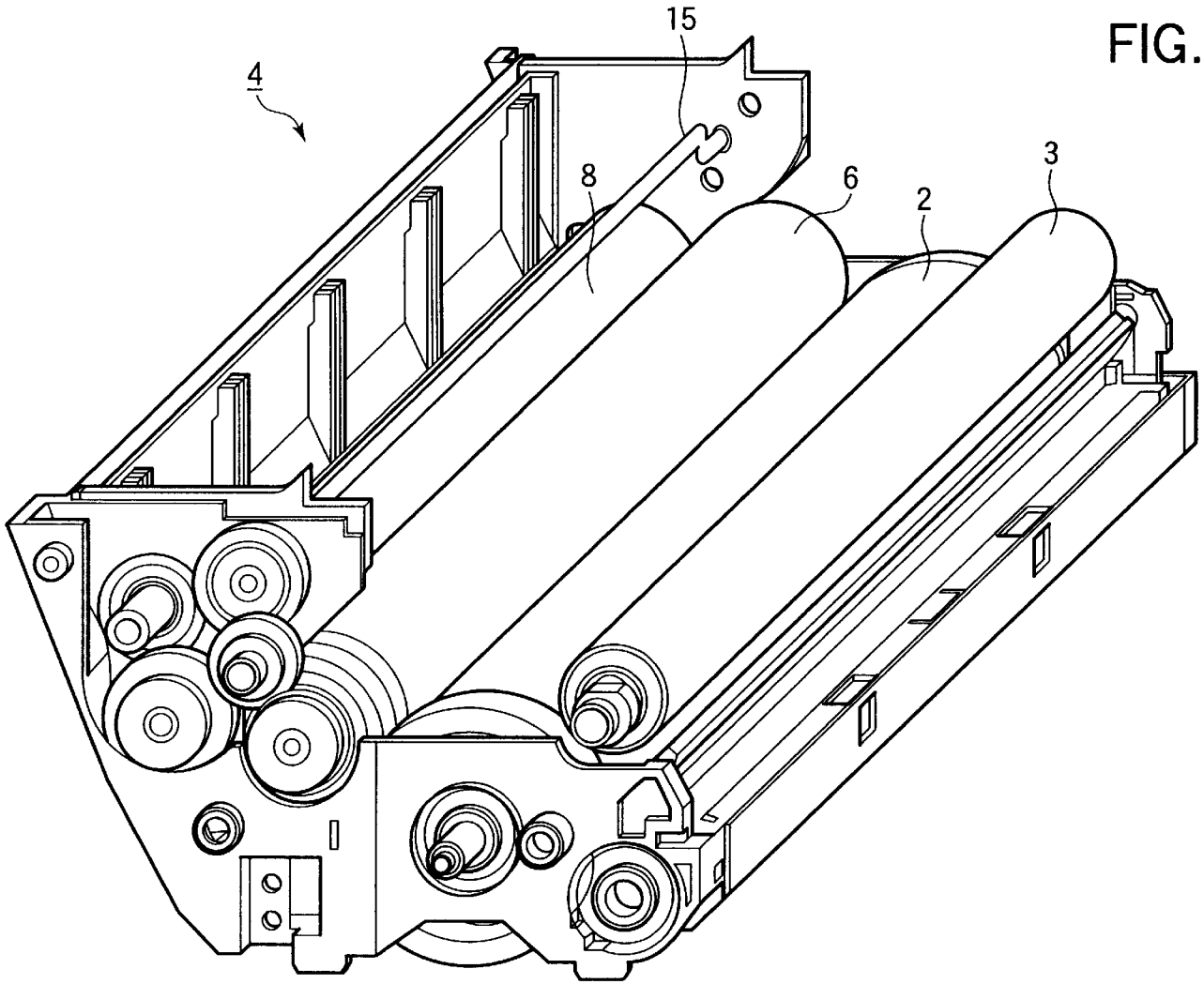
FIG. 6 is a perspective view of the developing unit according to the second embodiment.

FIG. 6 is a perspective view of the developing unit according to the second embodiment.

Referring to FIGS. 5 and 6, the developing unit 4 has an agitating member 15 that is rotatable relative to the developing unit 4. The agitating member 15 is in the shape of a crankshaft and is disposed over the area where the developing roller 6 is in contact with the supplying roller 8. The rest of the construction is the same as the first embodiment, for example, the developing blade 7 is in contact with the developing roller 6 at a point spaced at least a predetermined specific distance from a position at which the supplying roller 8 is in contact with the developing roller 6.

The agitating member 15 rotates counterclockwise, i.e., in a direction shown by arrow D as the developing roller 6 and the supplying roller 8 rotate. The rotation of the agitating member 15 improves the fluidity of toner near the developing roller 6 and supplying roller 8. Therefore, the clumped toner and foreign materials in the toner will not stay in the area in which the developing roller 6 and developing blade 7 are in contact with each other.

Figure 7:
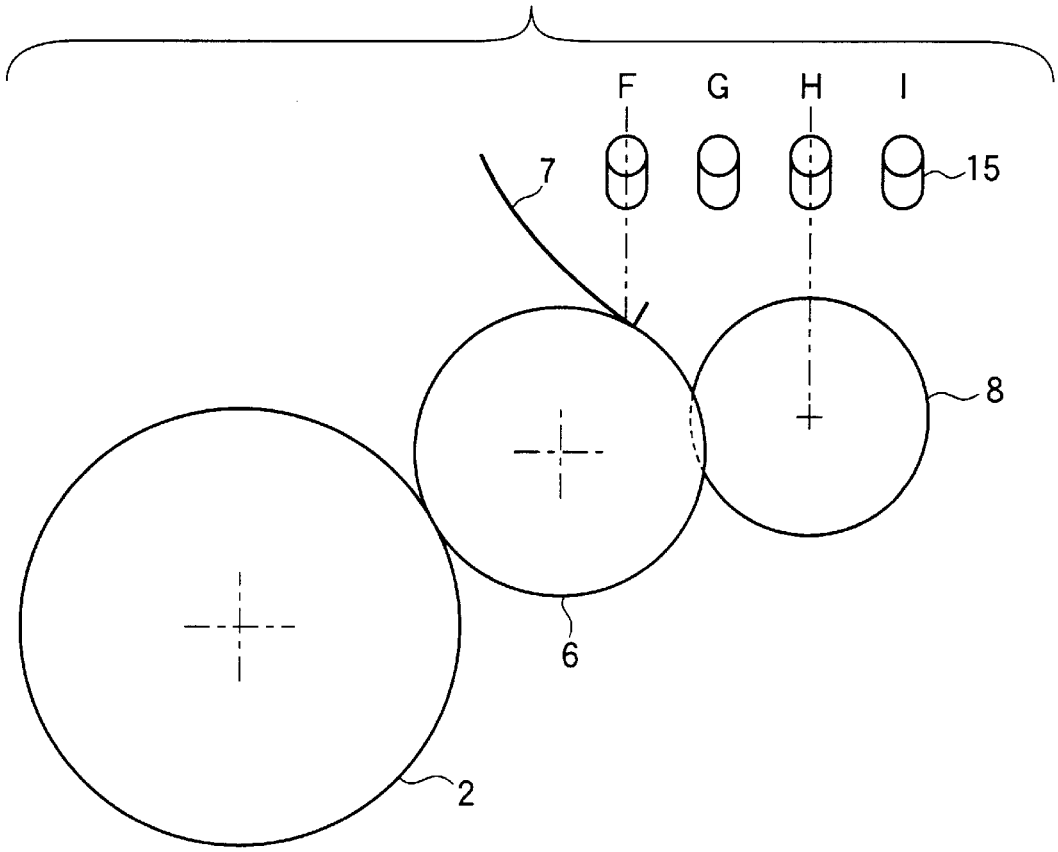
FIG. 7 illustrates different positions of an agitating member.
Figure 8:
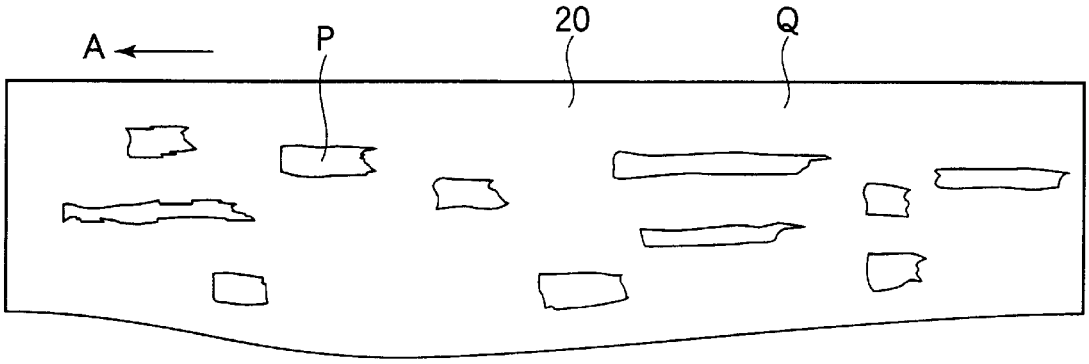
FIG.8 CONVENTIONAL ART
FIG. 8 illustrates an example of print results in which toner is not deposited sufficiently in some areas of a printed image.

FIG. 7 illustrates different positions F, G, H, and I of the agitating member 15. The position F is a point at which the developing blade 7 is in contact with the developing roller 6 and the position H is immediately over the rotational axis of the supplying roller 8.

TABLE 2

| POSITION OF AGITATING MEMBER | F | G | H | I |
|---|---|---|---|---|
| AREAS OF LOW DENSITY | NO | NO | NO | YES |

The experiment was carried out for different positions F, G, H, and I to determine whether an area of low density appears in printed images. Table 2 lists the results of the experiment. As is clear from Table 2, an area of low density does not appear at positions F to H but at position I. This experiment shows that the agitating member 15 should be disposed between a position immediately over the point where the developing blade 7 is in contact with the developing roller 6 and a point immediately over the rotational axis of the supplying roller 8.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developing unit having a developing member that supplies toner to an electrostatic latent image formed on an image bearing body, and a supplying member that rotates in contact with the developing member to supply the toner to the developing member, the developing unit comprising:

an opening formed in an upper portion of the developing unit through which the toner is received from outside, the toner falling through the opening directly onto an area in which the developing member and the supplying member are in contact with each other; and a developing blade that is in pressure contact with the developing member to form a thin layer of toner on the developing member;

wherein said developing blade is in contact with the developing member at a first nip and said supplying member is in contact with the developing member at a second nip, a center-to-center distance between the first nip and the second nip being greater than about 5.84 mm.

2. The developing unit according to claim 1, wherein the developing member and the supplying member receive negative voltages.

3. The developing unit according to claim 1, wherein the developing member is a roller having a diameter of substantially 20 mm.

4. The developing unit according to claim 3, wherein the developing member is made of either a silicone rubber or a urethane rubber.

5. The developing unit according to claim 1, wherein the supplying member is a roller having a diameter of substantially 16 mm.

6. The developing unit according to claim 5, wherein the supplying member is made of a silicone sponge.

7. A developing unit disposed substantially directly under an opening formed in a toner chamber through which toner is discharged into the developing unit, the developing unit comprising;

a developing member that rotates to supply toner to an electrostatic latent image formed on an image bearing body;

a supplying member that rotates in contact with the developing member to supply the toner to the developing member;

a developing blade that is in pressure contact with said developing member to form a thin layer of toner on the developing member; and a toner agitating member provided over said developing member and said supplying member, said toner agitating member rotating about an axis substantially parallel to said developing member, said toner agitating member rotating in a same direction as said developing member;

wherein said developing blade is in contact with the developing member at a first nip spaced at least a predetermined distance from a second nip at which said supplying member is in contact with said developing member.

8. The developing unit according to claim 7, wherein the agitating member is over a point between the first nip and a rotational axis of the supplying member.

9. The developing unit according to claim 7, wherein the agitating member is a deformed bar shaft.

10. The developing unit according to claim 9, wherein the agitating member is crank-shaped.

11. The developing unit according to claim 7, wherein the toner is poured from the toner chamber directly onto the opening onto an area in which the developing member and the supplying member are in contact with each other.

12. The developing unit according to claim 11, wherein a center-to-center distance between the first nip and the second nip is at least 5.84 mm.

13. The developing unit according to claim 12, wherein the developing member and the supplying member receive negative voltages.

14. The developing unit according to claim 7, wherein the agitating member rotates in a same direction as said supplying member.

15. A developing unit disposed substantially directly under a toner chamber from which toner is discharged into the developing unit, the developing unit comprising:

a developing member that supplies toner to an electrostatic latent image formed on an image-bearing body;

a supplying member that rotates in contact with the developing member to supply the toner to the developing member;

an opening formed in an upper portion of the developing unit through which the toner is received from the toner chamber, the toner falling by its own weight through the opening directly onto an area in which said developing member and said supplying member are in contact with each other;

a developing blade that is in pressure contact with the developing member to form a thin layer of toner on the developing member, wherein said developing blade is in contact with the developing member at a first position spaced at least a predetermined distance from a second position at which the supplying member is in contact with the developing member, a center-to-center distance between the first position and the second position being longer than 5.84 mm.

16. The developing unit according to claim 15, wherein said developing member and said supplying member receive negative voltages.

17. The developing unit according to claim 15, further comprising an agitating member over a position between said developing member and said supplying member wherein said agitating member rotates in a same direction as said developing member.

18. The developing unit according to claim 17, wherein said agitating member rotates in a same direction as said supplying member.

* * * * *